US006123327A

United States Patent [19]

Holland-Letz et al.

[11] Patent Number: 6,123,327

[45] Date of Patent: Sep. 26, 2000

[54] CASH DISPENSER

[75] Inventors: Guenter Holland-Letz, Paderborn; Manfred Krafft, Salzkotten; Hans-Guenter Voss, Paderborn; Peter Weigel, deceased, late of Borchen, by Brigitte Weigel, executrix; by Michaela Weigel, executrix, Paderborn; by Frederike Weigel, executor; by Gregor Weigel, executor, both of Borchen, all of Germany

[73] Assignee: Siemens Nixdorf Informationssysteme Aktiengesellschaft, Paderborn, Germany

[21] Appl. No.: 09/142,684

[22] PCT Filed: Mar. 3, 1997

[86] PCT No.: PCT/DE97/00387

§ 371 Date: Jul. 8, 1999

§ 102(e) Date: Jul. 8, 1999

[87] PCT Pub. No.: WO97/34263

PCT Pub. Date: Sep. 18, 1997

[30] Foreign Application Priority Data

Mar. 13, 1996 [DE] Germany ..... 196 09 866

[51] Int. Cl.[7] ..... B65H 5/22; B65H 3/44; B65H 7/08; E05G 1/00

[52] U.S. Cl. ..... 271/4.09; 902/9; 902/13; 271/9.01

[58] Field of Search ..... 271/4.09, 9.01; 902/2, 13

[56] References Cited

U.S. PATENT DOCUMENTS

| | | | |
|---|---|---|---|
| 4,434,359 | 2/1984 | Watanabe | 235/379 X |
| 5,813,510 | 9/1998 | Rademacher | 194/206 |

FOREIGN PATENT DOCUMENTS

| | | | |
|---|---|---|---|
| 0 024 704 B1 | 3/1981 | European Pat. Off. . | |
| 0 207 702 A2 | 1/1987 | European Pat. Off. . | |
| 0 517 404 A2 | 12/1992 | European Pat. Off. . | |
| 0 547 308 A1 | 6/1993 | European Pat. Off. . | |
| 38 34 062 A1 | 4/1989 | Germany . | |
| 401231196 | 8/1989 | Japan | 271/9.09 |
| 2 046 975 | 11/1980 | United Kingdom . | |
| 2 119 993 | 11/1983 | United Kingdom . | |

*Primary Examiner*—Christopher P. Ellis
*Assistant Examiner*—Kenneth W. Bower
*Attorney, Agent, or Firm*—Hill & Simpson

[57] ABSTRACT

The automatic cash dispenser has the following elements, a safe (18) for receiving at least one banknote cassette (32) and a separating device (34) for drawing off the banknotes out of the banknote cassette (32), of a banknote-dispensing compartment (50), which can be closed by a closure device (52), of a conveying device for conveying the banknotes from the separating device (34) to the dispensing compartment (50), of a control device for controlling the separating and the conveying devices. Also an operating panel (14, 16) with actuating elements for actuating the control device. The dispensing compartment (50) is arranged above the safe (18). In a central region of its top surface (22), the safe (18) has an aperture (42) for the through-passage of the conveying device. The conveying device is made up of a first conveying section (36, 38), which extends, within the safe, to a transfer location (46) in the vicinity of the aperture (42), and of a second conveying section (44, 48), which can be released from said first conveying section and extends from the transfer location (46) to the dispensing compartment (50).

20 Claims, 6 Drawing Sheets

CASH DISPENSER

BACKGROUND OF THE INVENTION

The invention relates to an automatic cash dispenser.

Automatic cash dispensers of this type are known, for example, from European reference EP-B-0 024 704. With such automatic cash dispensers, a distinction is made, depending on their loading direction, between units in which the banknote cassettes are pushed into the safe from the front side, which contains the operating panel, or from the rear side of the automatic cash dispenser. Apart from the fact that the known automatic cash dispensers of the abovementioned type are relatively large and involve high outlay, it is also usually the case that the subassemblies which are used for their construction are designed, and can be used, just for one type of loading operation. This makes it difficult for the units to be adapted to customer requirements as far as the loading direction is concerned and also increases the production costs.

German reference DE-38 34 062 A1 describes an automatic cash dispenser having a safe, separating device, banknote-dispensing compartment with closure device, conveying device control device and operating panel with actuating elements for actuating the control device, the dispensing compartment being arranged above the safe. In this automatic cash dispenser, the safe comprises an open container which can be closed by a cover and has two storage units for banknotes. For the purpose of refilling the unit with banknotes, the safe can be removed from said unit. Once the cover has been removed and the safe has been introduced into the unit, the safe is raised, with the result that the separating devices pass into the open container and can be advanced to the storage regions for the banknotes.

Great Britain reference GB-20 46 975 A discloses an automatic cash dispenser according to the preamble of claim 1. A vertical conveyor, which leads laterally past the banknote cassettes, opens out directly into an intermediate conveying path which passes through the aperture in the top side of the safe. This results in the aperture being arranged with pronounced eccentricity. The collecting station is designed as a set-down plate which can be tilted about a horizontal axis and is located above the safe. Once a banknote bundle has been gathered together, the set-down plate is tilted in the direction of a dispensing compartment, and the banknotes slide into the dispensing compartment just by the action of gravity alone. Also arranged above the safe, in the conveying path for the banknotes, is a diverter, which directs into a compartment, which is likewise located above the safe, banknotes which are not intended to be dispensed.

Great Britain reference GB-21 19 993 A discloses an automatic cash dispenser which in a top housing part, which is located above a bottom housing part, which receives the banknote cassettes, has a collecting conveyor with a stacking wheel, with the aid of which banknotes which have been drawn off individually can be collected to form a bundle.

SUMMARY OF THE INVENTION

The object of the invention is to specify an automatic cash dispenser of the type mentioned in the introduction which saves space and is inexpensive to produce and in the case of which the loading direction can be changed by straightforward means.

Since most of the second conveying section runs outside the safe, the latter, as a whole, can be made shallower. Since the second conveying section can be interlinked with parts of the operating panel which are arranged above the safe, it is also thus possible for the overall height of the unit to be reduced. This makes it possible to design automatic cash dispensers as desk-top units.

The single aperture, which is arranged centrally in the top surface of the safe, makes it possible for a unit in which the banknote cassettes are pushed in from the front side to be converted, without any great amount of outlay being involved, into a unit in which the cassettes are pushed in from the rear side, this being done by the entire structure of the unit, also including the second conveying section, being turned through 180° about the vertical axis relative to the safe. The second conveying section can also be coupled, in this position, to the first conveying section at the transfer location without any great changes being made.

The first conveying section is preferably made up of a vertical conveyor, which adjoins the separating device and extends over the height of the banknote cassette, of a collecting conveyor, which adjoins said vertical conveyor and is intended for collecting those banknotes which have been drawn off individually out of the banknote cassette in order thus to form a bundle in a collecting station, and of a bundle conveyor, which extends from the collecting station to the transfer location. The collecting conveyor and the bundle conveyor may thus be arranged on a first modular frame, which can be pushed into the safe, while the separating device and the vertical conveyor are arranged on a second modular frame, which can be pushed into the safe. Instalation of further modular frames of the second type thus allows the unit to be extended by further banknote cassettes without any design changes being made to the individual arrangements.

The second conveying section is preferably made up of an intermediate conveying path, which extends through the aperture, and of a horizontal conveying path, which is directed at least approximately parallel to the top surface of the safe.

In a preferred embodiment of the automatic cash dispenser according to the invention, the collecting conveyor is made up of a stacking wheel as well as a double belt drive, which extends from the vertical conveyor approximately over the height of the stacking wheel and, at its top end, has a deflecting surface such that the banknotes are introduced, by the double belt drive, into the stacking wheel at least approximately parallel to a horizontal tangent to said stacking wheel. As they are transferred from the double belt drive to the stacking wheel, banknotes are thus moved essentially horizontally, i.e. parallel to the top surface of the safe, with the result that there is no need for any further space above the collecting conveyor but it is nevertheless ensured that banknotes which miss the stacking wheel pass, over the latter, into the collecting station.

A space-saving, technically straightforward and reliable design of the collecting station is achieved in that the bundle conveyor is made up of conveying elements which are arranged parallel to one another, are connected to carry-along elements and, together with the latter, form a set-down means for collecting the banknotes which have been discharged from the stacking wheel, and in that the conveying elements are assigned pressure-exerting fingers which can be adjusted between a collecting position, in which they release the set-down means so that a banknote bundle can be formed, and a pressure-exerting position, in which they are directed parallel to the movement path of the conveying elements and force the banknote bundle against the conveying elements. It is preferable here for top and bottom pressure-exerting fingers to be provided, and these may respectively be pivoted, in opposite directions, about a top and bottom pivot pin directed parallel to the set-down plane. In this case, the conveying elements may be formed by conveying belts or else by toothed racks which can be adjusted via driving gear wheels. The advantage of the pressure-exerting fingers is that, other than for the pivot movement, they do not need to be driven and, for their actuating movement, they only require a small amount of space since for example in their position in which they are remote from the conveying elements they can pass into axis-normal slits in the stacking wheel. Such a space-saving solution would not be possible if there were provided, instead of the pressure-exerting fingers, a second belt drive, which, for the purpose of collecting the banknotes to form a bundle in the collecting station, would have to be pivoted away from the conveying elements.

For the case where, for whatever reason, the dispensing operation has to be interrupted or where a banknote bundle which is already located in the dispensing compartment is not removed and thus has to be retrieved, the automatic cash dispenser is usually provided with a collecting or reject cassette, which is also usually introduced into the safe, or removed therefrom, in the same direction as the banknote cassettes. According to the invention, the collecting cassette is arranged level with the collecting conveyor, the inlet opening being arranged in the vicinity of the transfer location between the first and the second conveying sections. Provided at the transfer location are a deflecting roller and a diverter with deflecting fingers, which can be pivoted between a first position, in which they release the conveying path between the first conveying section and the second conveying section, and a second position, in which they deflect to the inlet opening of the collecting cassette those banknotes which have been conveyed back by the second conveying section. This makes it possible, by extremely simple means and without any additional conveying paths being required, for the rejected or retrieved banknotes to be conveyed into the collecting cassette.

In order to ensure that individual banknotes and banknote bundles of different thicknesses are conveyed reliably in the second conveying section, the intermediate conveying path is made up of a top and a bottom belt conveyor, of which the belt rollers are each arranged on a rocker, the rockers being prestressed, i.e. sprung, toward one another. Depending on the thickness of the banknote bundle which is to be conveyed, the belt conveyors are thus forced apart from one another to a greater or lesser extent.

In the solution according to the invention, the conveying directions of the intermediate conveyor and horizontal conveyor are at least approximately at right angles to one another. Upon transfer from the intermediate conveyor into the horizontal conveyor, it is thus necessary for the banknote bundles to be deflected through a relatively large angle of, in some circumstances, more than 90°. This means that an offset of the individual banknotes within the bundle, as a result of them being at different distances from the axis of curvature of the deflecting surface, cannot be avoided. However, this offset can be kept small in that the horizontal conveying path has a top and a bottom belt conveyor, and in that the belts of the bottom belt conveyors of the horizontal conveyor and of the intermediate conveyor are guided over first deflecting rollers, which are mounted coaxially with respect to one another, and the belts of the top belt conveyors of the horizontal conveyor and of the intermediate conveyor are guided over second deflecting rollers, which are mounted coaxially with respect to one another. The intermediate conveyor and the horizontal conveyor are thus directed in each case tangentially to the deflecting surface, i.e. a deflecting roller, with the result that the banknotes of the banknote bundle are not conveyed at different circumferential speeds over the entire deflecting angle, which would result in the bundle being fanned out to a large extent.

The intermediate conveyor, the horizontal conveyor and the closure device are preferably arranged on a third frame, which can be positioned on the safe. This largely avoids any adjustment problems at the transfer locations between the individual conveyors and the horizontal conveyor and the closure device. As a result, the assembly of the unit is rendered simpler and less expensive.

In a preferred embodiment of the invention, the closure device is formed by a partially cylindrical flap which is mounted on the third frame so as to be pivotable about the cylinder pin and of which the pivot movement between an open position and a closed position is controlled via a cam plate. This cam plate is preferably driven by a stepping motor via a reduction gear mechanism. Firstly, the closure flap can thus be pivoted with a large amount of force, and thus reliably and precisely. Secondly, it is possible for the force by which the closure flap is moved to be limited in that, when the flap is secured in its end positions or strikes against an obstacle, the stepping motor loses steps, i.e. slips. This is necessary in order to ensure that it is not possible for a user's fingers to be caught in the closing flap.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

Figure 1:
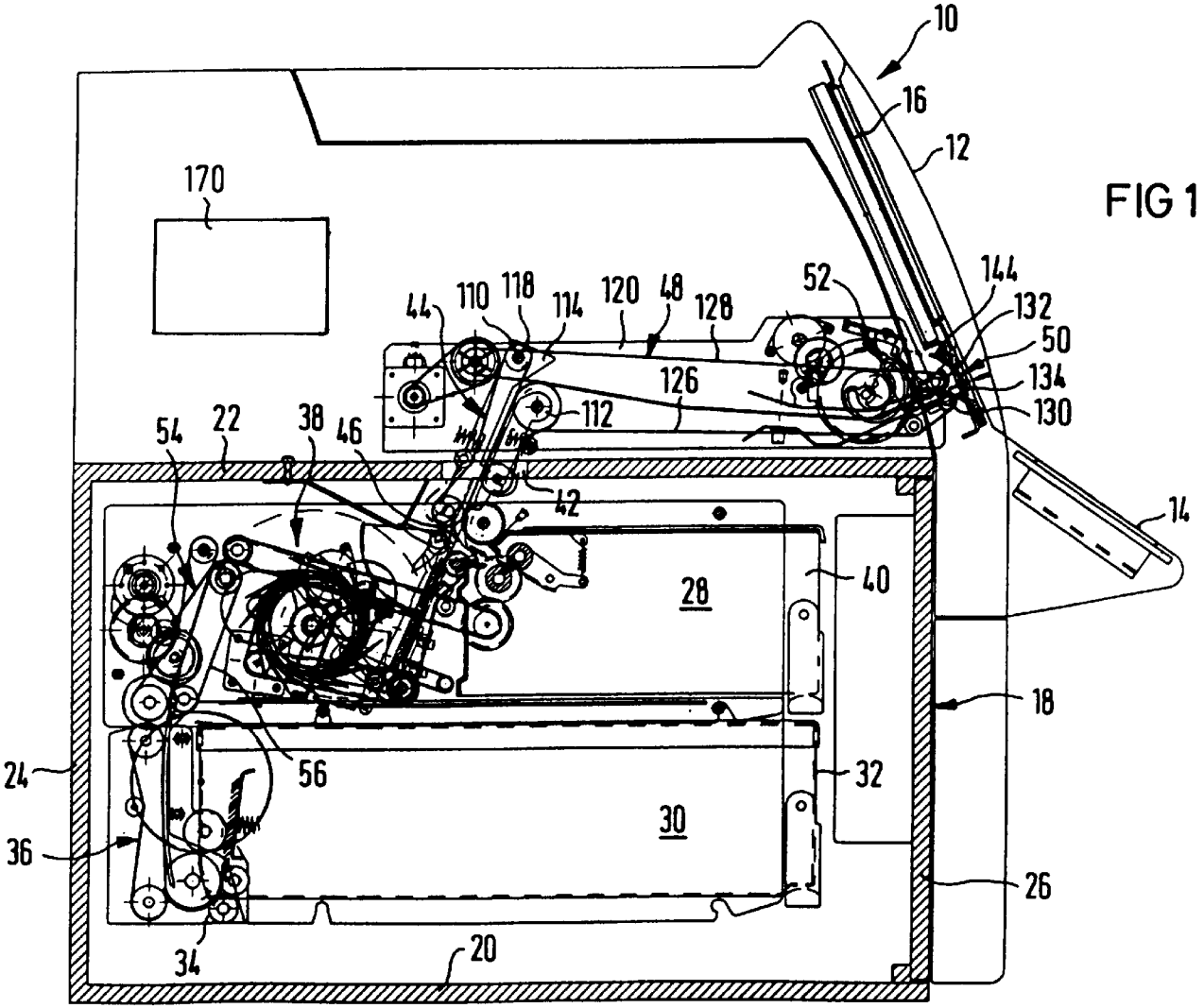
FIG. 1 shows a schematic vertical section through an inventive automatic cash dispenser with the safe door arranged on the front side of the dispenser.

The automatic cash dispenser, which is illustrated partially schematically in FIG. 1, comprises a housing which is designated in general terms by 10 and has a front side 12 on which there are located an operating console 14 and a display device 16, which is formed by a screen. Enclosed in the housing 10 is a safe 18 with a base 20, a top surface 22 and side walls 24, of which only one is illustrated. On its side which is directed toward the front side of the housing 10, the safe 18 has a door 26.

A first modular frame 28 and a second modular frame 30 are pushed into the safe 18, on guides (not illustrated). A banknote cassette 32 with banknotes which are stacked in an upended manner may be introduced into the second modular frame 30. The second modular frame 30 also contains a separating device 34 and a vertical conveyor 36, which conveys the separated banknotes upwards and extends over the height of the modular frame 30.

The first modular frame 28 contains a collecting conveyor, which is designated in general terms by 38 and is intended for receiving the separated banknotes from the vertical conveyor 36 and for forming a banknote bundle, as will be explained in more detail with reference to FIGS. 2 and 3 at a later stage in the text, and said first modular frame 28 serves for receiving a reject cassette 40 which serves for collecting those banknotes which, on account of an incorrect, and therefore interrupted, dispensing operation, are not dispensed or have to be retrieved because the customer, for whatever reason, has not removed the banknote bundle.

In a central region, the top surface of the safe has an aperture 42, through which there extends an intermediate conveyor 44 which can be coupled to the collecting conveyor 38, at a transfer location 46, and, outside the safe 18, is connected to a horizontal conveyor 48, which connects the intermediate conveyor 44 to a dispensing compartment 50, which is arranged on the front side 12 of the housing. The dispensing compartment 50 can be closed by a closure device, which is designated in general terms by 52.

The collecting conveyor 38 comprises a double belt drive 54 having a first belt 56, which is guided over rollers 58, 60, and having a second belt 62, which is guided over rollers 64, 66. The bottom end of the double belt drive 54 adjoins the top end of the vertical conveyor 36 and receives individual banknotes coming from the latter. Arranged at the top end of the double belt drive 54 is a deflecting surface 68 which is curved coaxially with respect to the roller 60 and by means of which individual banknotes which have been gripped by the two belts 56, 62 are deflected in the direction of a stacking wheel 70. The stacking wheel 70 and the double belt drive 54 are arranged relative to one another such that the banknotes which are deflected by the deflecting surface 68, in FIG. 3, run into the compartments of the stacking wheel 70 approximately horizontally and tangentially to the top side of said stacking wheel. From the stacking wheel 70, which rotates in the clockwise direction and is known per se, the banknotes which have been gripped, and are represented in FIG. 2 by chain-dotted lines 72, are moved to a collecting station or set-down means, designated in general terms by 74, and are stacked one upon the other to form a bundle 76. The set-down means is made up of conveying belts 78 which are located one beside the other, are guided over rollers 80, 82 and on which there are fastened carry-along elements 84, which are illustrated in their bottom position in FIGS. 2 and 3. The belts 78, which are located in one plane, form an abutment surface for the banknotes which have been set down by the stacking wheel 70, the banknotes being positioned on the carry-along elements 84.

Figure 2:
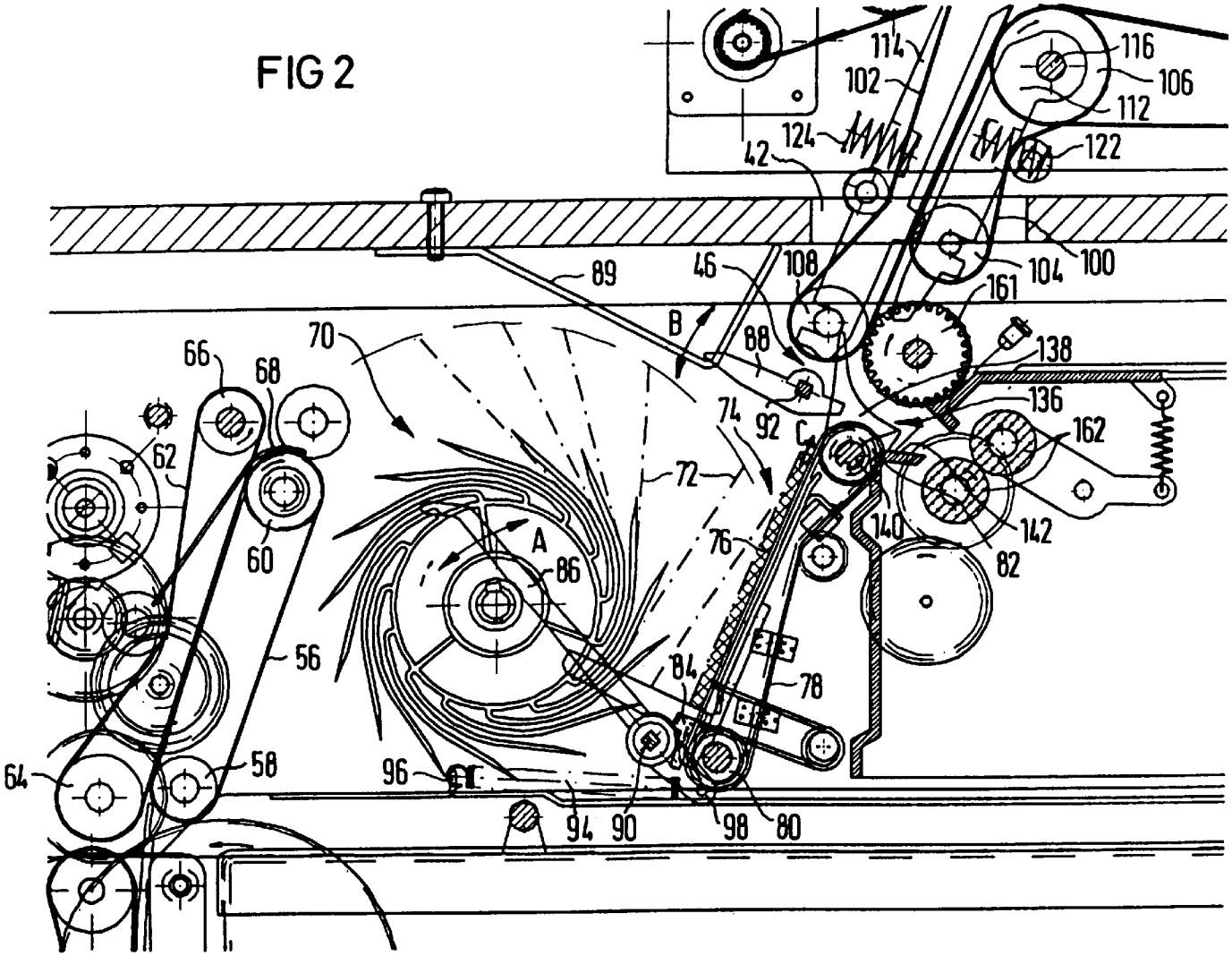
FIG. 2 shows an enlarged detail, which shows the collecting station and the intermediate conveyor, from the illustration in FIG. 1 with the pressure-exerting elements in their collecting position.
Figure 3:
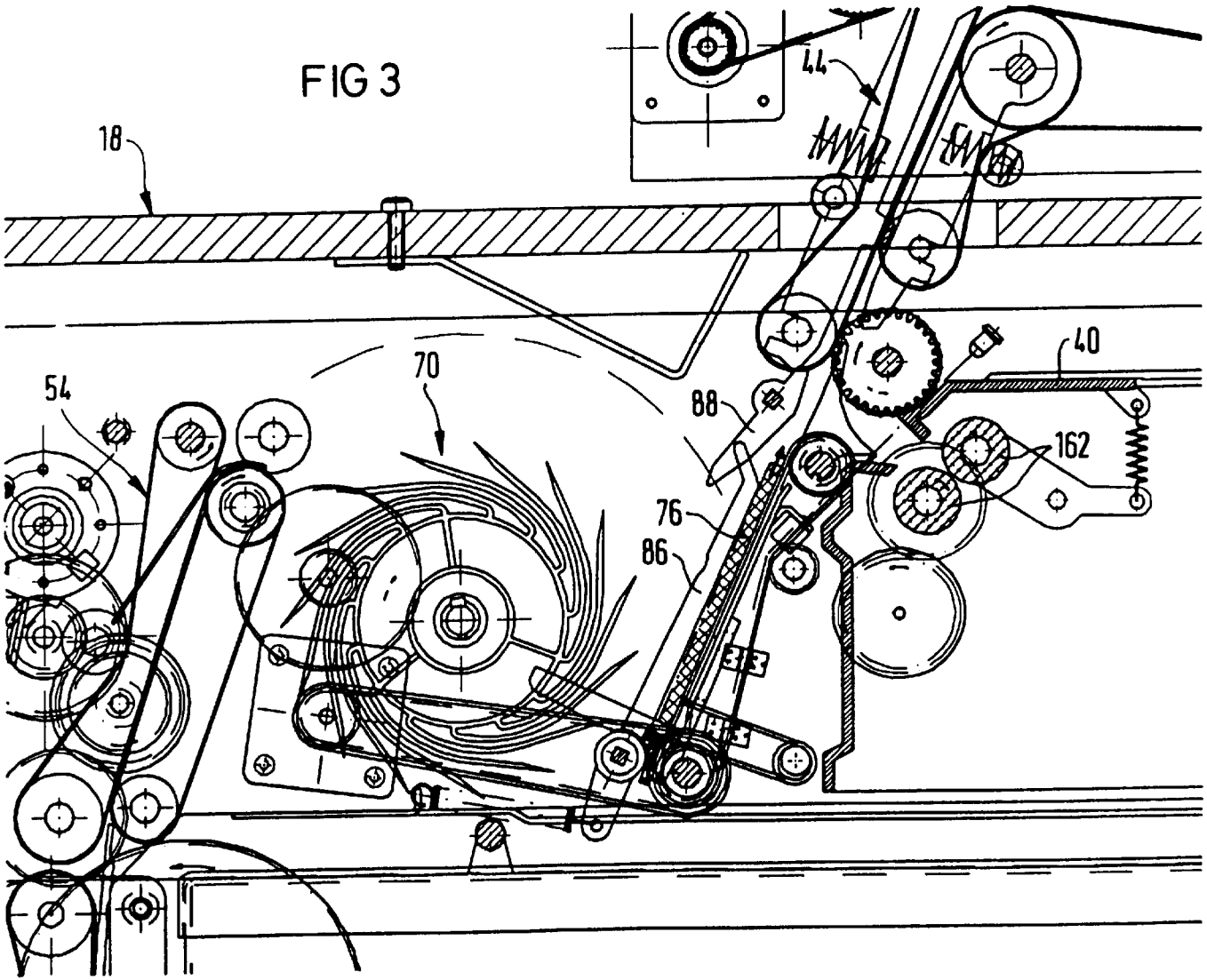
FIG. 3 shows an illustration, corresponding to FIG. 2, with the pressure-exerting elements in their conveying position.

The conveying belts 78 are assigned bottom conveying fingers 86 and top conveying fingers 88, which are each respectively fastened on a shaft 90, 92, parallel to the axes of the rollers 80 and 82, and can be pivoted, in opposite directions, between a collecting position, which is illustrated in FIG. 2, and the conveying position, which is illustrated in FIG. 3, as is indicated by the double arrows A and B in FIG. 2. In their collecting position, which is illustrated in FIG. 2, the pressure-exerting fingers 86 pass into axis-normal slits in the stacking wheel 70. In this case, the top transporting fingers 88 adjoin a guide plate 89, which directs reliably into the set-down means 74 even banknotes which fly past the stacking wheel 70. The shafts 90 and 92 are coupled to one another via toothed segments 93, with the result that they can be pivoted synchronously and in opposite direction, by a motor (not illustrated), into their collecting position from their conveying position. The return into the conveying position takes place via a spring 94, which acts, on the one hand, on an eyelet 96 formed on the modular frame 28 and, on the other hand, on a continuation 98 connected to the pressure-exerting fingers 86.

The bundle conveyor, which comprises the conveying belts 78 and the pressure-exerting fingers 86, 88, conveys the banknote bundle 76, which has been formed in the set-down means, upwards in the direction of the arrow C until such time as the bundle 76 can be gripped reliably by the intermediate conveyor 44.

The intermediate conveyor 44 comprises a bottom belt drive 100 and a top belt drive 102. The belts of the bottom belt drive 100 are guided over bottom rollers 104 and top rollers 106. The belts of the top belt drive 102 are guided over bottom rollers 108 and top rollers 110. The rollers 104, 106 and 108, 110 are each respectively mounted on a rocker 112 or 114, these rockers, for their part, being mounted on a frame 120 so as to be pivotable about the pivot pin 116 of the rollers 106 or the pivot pin 118 of the rollers 110. The rockers 112 and 114 are stressed against one another by compression springs 122 and 124, respectively, with the result that the belt drives 100 and 102 butt closely against one another, but can be forced apart from one another by a banknote bundle.

The deflecting rollers 106 and 110 of the bottom belt drive 100 and of the top belt drive 102, respectively, form, at the same time, deflecting rollers for a bottom belt drive 126 and a top belt drive 128, respectively, of the horizontal conveyor 48, of which the belts also run about rollers 130 and 132 which are arranged in the vicinity of the dispensing opening 134 of the dispensing compartment 50.

All the belt drives illustrated are moved by electric motors via gear mechanisms (not illustrated), it being the case that at least the belt drive 78 of the bundle conveyor, the belt drives 100 and 102 of the intermediate conveyor 44 and the belt drives 126, 128 of the horizontal conveyor 48 can have their running directions reversed.

Located in the region of the transfer location 46 between the bundle conveyor and the intermediate conveyor 44 is a diverter 13F, comprising a series of deflecting fingers 138 which are arranged one beside the other and so as to be pivotable coaxially with respect to the shaft 140 of the deflecting rollers 82 of the conveying belt 78, and can be pivoted, synchronously with the adjustment of the pressure-exerting fingers 86, 88, between a through-passage position, which is illustrated in FIG. 3, and a deflecting position, which is illustrated in FIG. 2. The adjustment takes place here via the drive which also adjusts the pressure-exerting fingers 86, 88. In the through-passage position, according to FIG. 3, the deflecting fingers 138 release the path, in the direction of the intermediate conveyor 44, for the banknote bundle which has been formed in the collecting station. In the deflecting position, which is illustrated in FIG. 2, said fingers deflect into an inlet opening 142 of the collecting cassette 40 a banknote bundle which is conveyed back by the intermediate conveyor 44.

The dispensing opening 134 in the dispensing compartment 50 is closed by a partially cylindrical flap 144 which is mounted on the frame 120, by way of two pivot arms 146, so as to be pivotable about the cylinder pin 148. Connected to at least one pivot arm 146 is an actuating lever 150, which bears a peg 152 at its free end. This peg engages in a control groove 154 of a cam plate 156, which is likewise mounted rotatably on the frame 120 and can be adjusted by a stepping motor 158 via a gear mechanism 160. The distance by which the control groove 154 is spaced apart from the axis of rotation of the cam plate 156 changes over the length of said groove. The peg 152, which slides in the control groove 154, causes the actuating lever 150, and thus also the closure flap 144, to be pivoted as the cam plate 156 rotates. At each of its ends, the control groove 154 has a concentric section which prevents the peg 152 from rotating the cam plate 156 if any attempt is made to adjust the closure flap 144 from outside. This means that self-locking secures the closure flap 144 against manipulation.

While the module 28 can be drawn out of the safe 18, the frame 120, which contains the closure device 52 together with the second conveying section, which comprises the intermediate conveyor 44 and the horizontal conveyor 48, is arranged on the safe 18 in a stationary manner. This may result in positioning tolerances between the bundle conveyor, which is arranged on the modular frame 28, and the intermediate conveyor 44. These positioning tolerances are likewise compensated for by the resiliently mounted rockers 112, 114 of the intermediate conveyor 44.

The bottom belt rollers 108 are supported directly on large-diameter deflecting rollers 161 which are mounted rotatably on the modular frame 28, above the inlet opening 142 of the collecting container 40.

The relatively large deflecting angle between the intermediate conveyor 44 and the horizontal conveyor 48 results in an offset where relatively thick stacks of banknotes are concerned. The geometrical offset of $2\pi \times s$, where s is the thickness of the stack or bundle, is unavoidable. If the top belt were to butt against the radially outer banknote of the bundle over the entire deflection about the rollers 106, said banknote would be conveyed at the slow circumferential speed over its entire height and the offset would thus be at a maximum. This is avoided in that the belts of the top belt drives of the intermediate conveyor 44 and the horizontal conveyor 48 each butt tangentially against the deflecting rollers 106, so as to produce a free deflecting zone in the angle between the two top belt drives.

The apparatus which has been described thus far operates as follows:

The banknotes which have been drawn off by the separating device 34 are fed by the vertical conveyor 36 to the double belt drive 54 and, from the latter, run into the stacking wheel 70, by way of which they are collected on the set-down means. Once the pressure-exerting fingers 86 and 88 have been pivoted from the collecting position, which is illustrated in FIG. 2, into the pressure-exerting position, which is represented in FIG. 3, the carry-along elements 84 are moved upward by the conveying belt 78 and carry along the banknote bundle which has been formed. Synchronously with the upward movement, the intermediate conveyor 44 is activated. The latter receives the banknote bundle 76 and feeds it to the horizontal conveyor 48, which transports the bundle into the dispenser compartment, in which case the bundle is still retained by the horizontal conveyor 48. The operation of switching the various conveyors on and off is regulated by light barriers which are controled by the leading and trailing edges of the banknotes. The closure is opened and the money is positioned in the removal position. Should it be the case that, after a specific amount of time, the money has not been removed, the money-retrieval operation is initiated. For this purpose, pressure-exerting and directing fingers are pivoted into the collecting position, according to FIG. 2. The diverter 136, which is coupled to the pressure-exerting fingers, moves into the return position, which is illustrated in FIG. 2. The large deflecting rollers 161 above the opening 142 of the collecting cassette 40 are likewise driven backward and assist the operation of the banknotes being drawn into the collecting cassette 40 with the aid of a drawing-in drive 162.

If there are any irregularities in the operation of separating the notes, e.g. if two notes are drawn off at the same time, a rejection operation is initiated. In this case, the banknote bundle which has been collected on the set-down means is likewise moved into the collecting cassette. The bundle is pushed into the intermediate conveyor 44 until such time as the diverter 136 can be reliably switched over. The banknotes are then transported into the collecting cassette 40, just as in the case of the money-retrieval operation.

Figure 4:
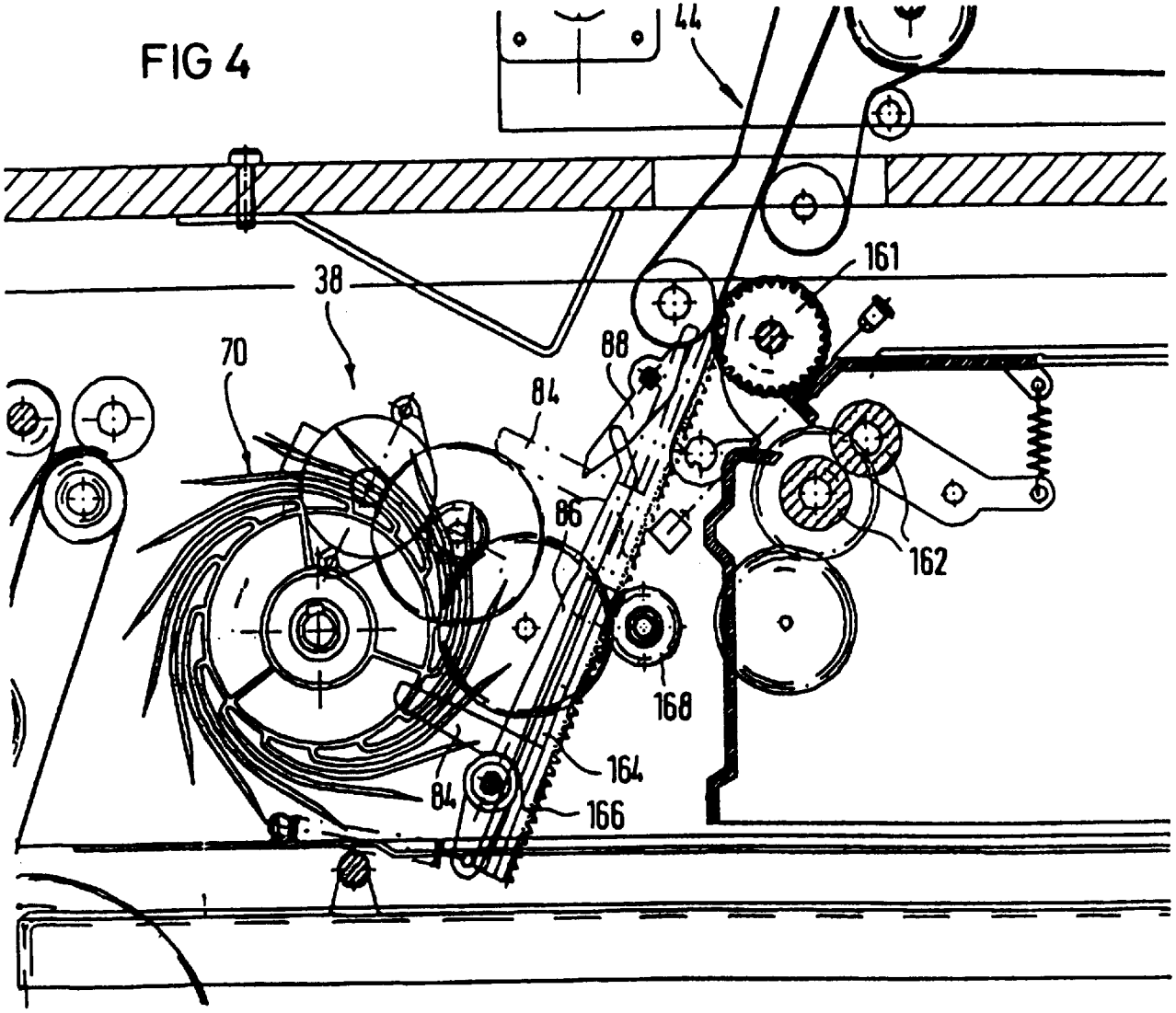
FIG. 4 shows an illustration, corresponding to FIGS. 2 and 3, with a modified embodiment of the bundle conveyor.

FIG. 4 shows a variant which differs from that embodiment which is illustrated in FIGS. 1 to 3 just by the type of conveying elements which belong to the bundle conveyor. Provided in this case, rather than conveying belts 78, are bars 164 which are arranged one beside the other, on which the carry-along elements 84 are fastened and which each bear, on their rear side, a toothed rack 166, these racks being driven via gear wheels 168. It is thus possible for the carry-along elements 84 to be adjusted up and down between the position which is represented in FIG. 4 by solid lines or the position which is represented by chain-dotted lines.

Figure 5:
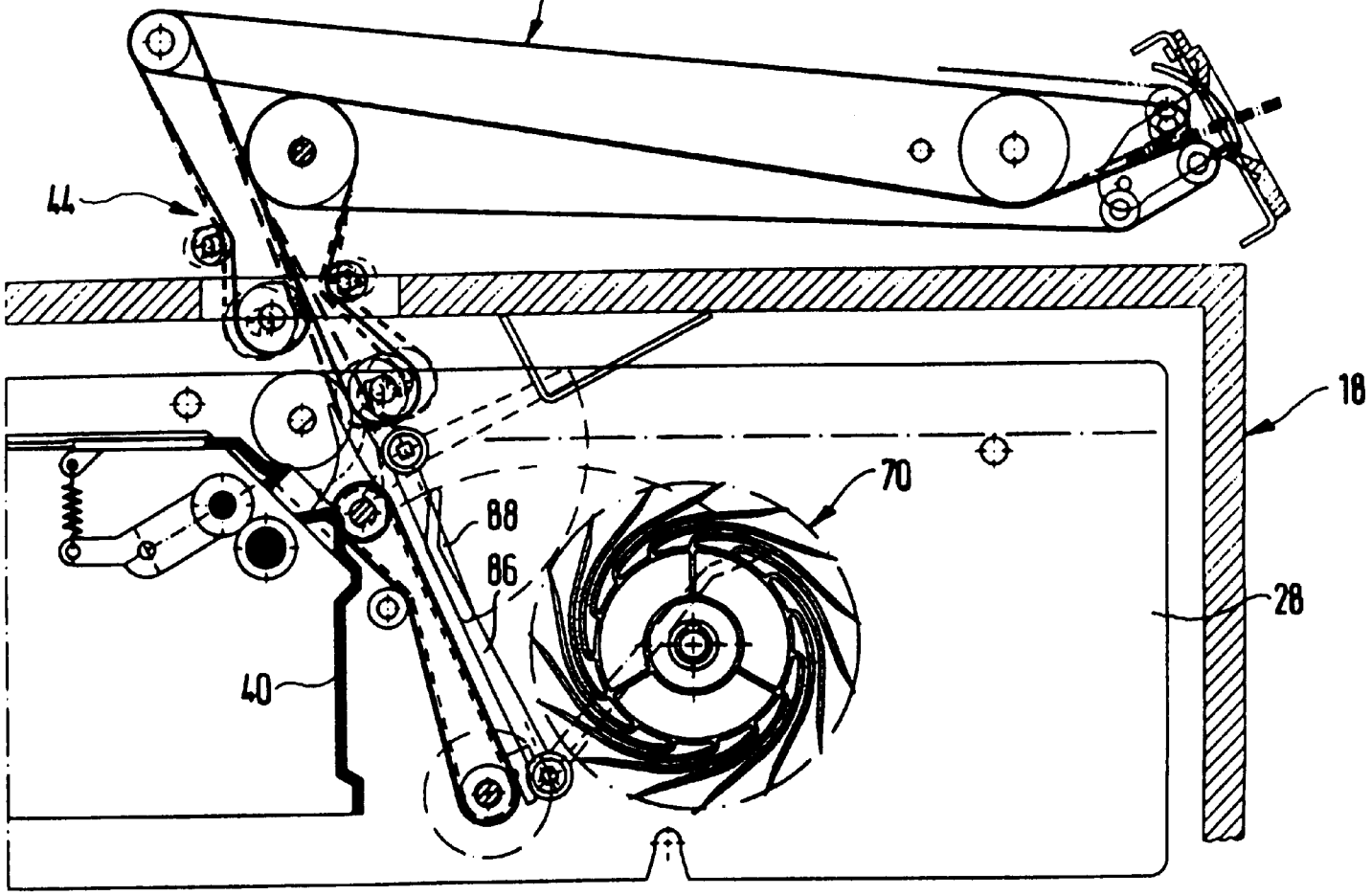
FIG. 5 shows a schematic partial vertical section through an inventive automatic cash dispenser with the cassettes having been pushed in from the rear side of the unit.
Figure 6:
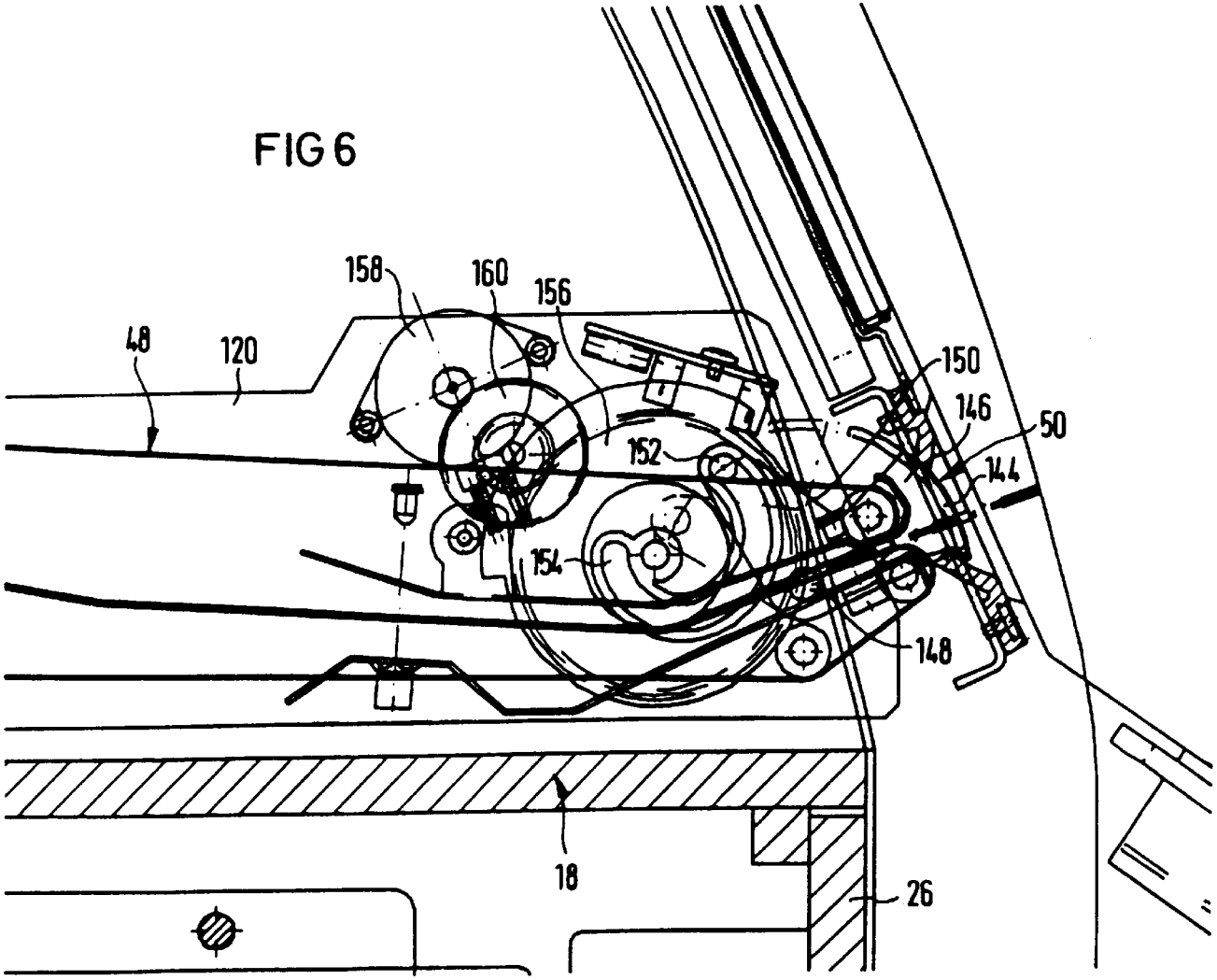
FIG. 6 shows an enlarged schematic sectional illustration of the closure device and of the dispensing compartment.

FIG. 5 shows a schematic detail of a variant which differs from that embodiment which is illustrated in FIGS. 1 to 4 in that the safe 18 with all the inserts 28, 30 as well as the frame 120, which bears the horizontal conveyor 48 and the intermediate conveyor 44, have been changed round through 180° relative to one another. This results in the door 26 of the safe 18 then being located on the rear side of the unit housing 10 and thus in it being possible for the modular frames 28, 30 and the cassettes 32, 40 to be pushed into the safe from the rear side of the unit. This necessitates a slight change in the position of the intermediate conveyor 44 relative to the horizontal conveyor 48. Otherwise, though, all the other elements remain unchanged. This means that, in line with customer requirements, the automatic cash dispenser can be assembled, using essentially the same elements, either in the form of a unit for front-loading operation or in the form of a unit for rear-loading operation.

Since the horizontal conveyor 48 together with other units (e.g. a control device 170, which is only schematically indicated) of the automatic cash dispenser which do not have to be accommodated in the safe 18 can be arranged one beside the other in the structure above the safe 18, the overall height of the automatic cash dispenser remains relatively low, with the result that the unit is also suitable for use as a desk-top unit.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. An automatic cash dispenser, comprising:

an integral safe for receiving at least one exchangeable banknote cassette containing banknotes, which is pushable into the safe from one side of the safe;

a separating device for drawing off the banknotes out of the banknote cassette;

a collecting station for collecting those banknotes which have been drawn off out of the banknote cassette in order to form a bundle;

a banknote-dispensing compartment, which is arranged above the safe and which is closeable by a closure device;

a conveying device for conveying the banknotes from the separating device to the dispensing compartment;

an operating panel having actuating elements for actuating the control device;

the safe having in a top surface of the safe an aperture for a through-passage of the conveying device;

the conveying device having a first conveying section, which extends, within the safe, to a transfer location in a vicinity of the aperture and which has a vertical conveyor, which adjoins the separating device and, on a side of the safe which is located opposite a side at which the at least one banknote cassette is pushed in, extends over a height of the banknote cassette;

the conveying device having a second conveying section, the second conveying section having an intermediate conveying path, which extends through the aperture, and having a horizontal conveyor, which is directed at least approximately parallel to the top surface of the safe and extends from the transfer location to the dispensing compartment;

aperture being arranged in a central region of the top surface of the safe;

the first transporting section, which is arranged in the safe, having a collecting conveyor, which adjoins the vertical conveyor and collects those banknotes which have been drawn individually out of the banknote cassette in order to form a bundle in the collecting station, and the first transporting section having a bundle conveyor, which extends from the collecting station to the transfer location;

the collecting conveyor having a stacking wheel which is arranged above the at least one banknote cassette, in a region between the vertical conveyor and the intermediate conveying path;

the collecting conveyor having a double belt drive which extends from the vertical conveyor approximately over a height of the stacking wheel and, at a top end thereof, has a deflecting surface such that the banknotes are introduced, by the double belt drive, into the stacking wheel at least approximately parallel to a horizontal tangent to said stacking wheel.

2. The automatic cash dispenser as claimed in claim 1, wherein arranged level with the collecting conveyor is a collecting cassette for retrieving non-dispensed banknotes, the collecting cassette having an inlet opening in a vicinity of a transfer location between the first and the second conveying sections, and wherein arranged at the transfer location are a deflecting roller and a diverter with deflecting fingers, which can be pivoted between a first position, in which the roller and diverter release the conveying path between the first conveying section and the second conveying section, and a second position, in which the roller and diverter deflect to the inlet opening of the collecting cassette those banknotes which have been conveyed back by the second conveying section.

3. The automatic cash dispenser as claimed in claim 1, wherein the intermediate conveying path has a top belt conveyor and a bottom belt conveyor, each of the conveyors having belt rollers, each of the belt rollers arranged on a respective rocker, the rockers being prestressed toward one another.

4. The automatic cash dispenser as claimed in claim 3, wherein the horizontal conveying path has a top belt conveyor and a bottom belt conveyor, and wherein belts of the bottom belt conveyors of the horizontal conveying path and of the intermediate conveying path are guided over first deflecting rollers, which are mounted coaxially with respect to one another, and wherein the belts of the top belt conveyors of the horizontal conveying path and of the intermediate conveying path are guided over second deflecting rollers, which are mounted coaxially with respect to one another.

5. The automatic cash dispenser as claimed in claim 1, wherein the collecting conveyor and the bundle conveyor are arranged on a first modular frame, which can be pushed into the safe.

6. The automatic cash dispenser as claimed in claim 5, wherein the collecting cassette is pushable into the first modular frame.

7. The automatic cash dispenser as claimed in claim 1, wherein the bundle conveyor has conveying elements which are arranged parallel to one another, are connected to conveying elements and, together with the conveying elements, form a set-down device for collecting the banknotes which have been discharged from the stacking wheel, and wherein the conveying elements are assigned pressure-exerting fingers which are adjustable between a collecting position, in which the fingers release the set-down device so that a banknote stack can be formed, and a pressure-exerting position, in which the fingers are directed parallel to the movement path of the conveying elements and force the banknote bundle against the conveying elements.

8. The automatic cash dispenser as claimed in claim 7, wherein, in the collecting position, top transporting fingers of the pressure-exerting fingers adjoin a guide plate which is arranged above the stacking wheel and directs into the set-down device banknotes which fly past the stacking wheel.

9. The automatic cash dispenser as claimed in claim 7, wherein the pressure-exerting fingers consist of top and bottom pressure-exerting fingers that are pivotable in opposite directions, about a top and bottom pivot pin directed parallel to the set-down plane.

10. The automatic cash dispenser as claimed in claim 7, wherein the conveying elements are formed by conveying belts which are guided over drive rollers.

11. The automatic cash dispenser as claimed in claim 7, wherein the conveying elements are formed by toothed racks which are adjustable via driving gear wheels.

12. The automatic cash dispenser as claimed in claim 1, wherein the separating device and the vertical conveyor are arranged on a second modular frame, which can be pushed into the safe.

13. The automatic cash dispenser as claimed in claim 12, wherein the intermediate conveying path, the horizontal conveying path and the closure device are arranged on a third frame, which can be positioned on the safe.

14. The automatic cash dispenser as claimed in claim 13, wherein the closure device has a partially cylindrical flap which is mounted on the third frame so as to be pivotable about a cylinder pin, pivot movement thereof between an open position and a closed position being controlled via a cam plate.

15. The automatic cash dispenser as claimed in claim 14, wherein the cam plate is driven by a stepping motor via a reduction gear mechanism.

16. The automatic cash dispenser as claimed in claim 14, wherein the closure flap is connected to a lever which bears a peg which engages in a control groove of the cam plate, and wherein, at each end of the control groove, the control groove has a concentric section which prevents the peg from adjusting the cam plate if an external force acts on the closure flap.

17. The automatic cash dispenser as claimed in claim 12, wherein the banknote cassette is pushable into the second modular frame.

18. The automatic cash dispenser as claimed in claim 17, wherein the intermediate conveying path, the horizontal conveying path and the closure device are arranged on a third frame, which can be positioned on the safe.

19. The automatic cash dispenser as claimed in claim 18, wherein the closure device has a partially cylindrical flap which is mounted on the third frame so as to be pivotable about a cylinder pin, pivot movement thereof between an open position and a closed position being controlled via a cam plate.

20. The automatic cash dispenser as claimed in claim 19, wherein the closure flap is connected to a lever which bears a peg which engages in a control groove of the cam plate, and wherein, at each end of the control groove, the control groove has a concentric section which prevents the peg from adjusting the cam plate if an external force acts on the closure flap.

* * * * *